US009484629B2

(12) United States Patent
Hoang et al.

(10) Patent No.: US 9,484,629 B2
(45) Date of Patent: Nov. 1, 2016

(54) MULTI-USE ANTENNA

(75) Inventors: Peter S. Hoang, Snoqualmie, WA (US); Robert J. Hollyer, Bainbridge Island, WA (US); Jedd A. Perry, Monroe, WA (US)

(73) Assignee: MICROSOFT TECHNOLOGY LICENSING, LLC, Redmond, WA (US)

( * ) Notice: Subject to any disclaimer, the term of this patent is extended or adjusted under 35 U.S.C. 154(b) by 568 days.

(21) Appl. No.: 13/302,672

(22) Filed: Nov. 22, 2011

(65) Prior Publication Data

US 2013/0127683 A1 May 23, 2013

(51) Int. Cl.
*H01Q 7/00* (2006.01)
*H01Q 1/50* (2006.01)
*H01Q 1/22* (2006.01)

(52) U.S. Cl.
CPC . *H01Q 1/50* (2013.01); *H01Q 1/22* (2013.01)

(58) Field of Classification Search
CPC ..... H01Q 7/00; H01Q 1/24; H01Q 9/0442; H01Q 1/22; H01Q 1/50
USPC ..... 343/741, 744, 745, 858, 702, 866
See application file for complete search history.

(56) References Cited

U.S. PATENT DOCUMENTS 7,557,757 B2 7/2009 Deavours et al.
2006/0244676 A1* 11/2006 Uesaka ..... 343/895
2009/0189729 A1 7/2009 Kubo et al.
2009/0206165 A1 8/2009 Laackmann et al.
2010/0225272 A1* 9/2010 Kirby et al. ..... 320/108
2010/0277383 A1* 11/2010 Autti ..... H01Q 1/243 343/749
2011/0009057 A1 1/2011 Saunamaki
2011/0063173 A1 3/2011 Marcher et al.
2011/0177781 A1 7/2011 Berhorst et al.
2012/0149301 A1* 6/2012 Wiley ..... H04B 5/0031 455/41.1

FOREIGN PATENT DOCUMENTS

JP 07221529 A * 8/1995

OTHER PUBLICATIONS

"Radio-frequency-IDentification", Retrieved at <<http://www.rfid-handbook.de/rfid/types_of_rfid.html>>, Retrieved Date: Oct. 10, 2011, pp. 3.

* cited by examiner

*Primary Examiner* — Dieu H Duong
(74) *Attorney, Agent, or Firm* — Mila Sula; Judy Yee; Micky Minhas

(57) ABSTRACT

Multi-use antenna techniques are described. In one or more implementations, a device includes a single fixed radiating structure, a first branch coupled to the single fixed radiating structure to tune to a first frequency range to support a first wireless signal technique, and a second branch coupled to the single fixed radiating structure to tune to a second frequency range to support a second wireless signal technique, the second frequency range being different than the first frequency range.

13 Claims, 6 Drawing Sheets

MULTI-USE ANTENNA

BACKGROUND

The functionality that is provided by devices, including mobile devices, is ever increasing. For example, mobile devices such as telephones were initially configured to simply operate as a telephone. Functionality was then added to include processors capable of executing applications on the device itself, maintain calendars, provide a variety of different messaging techniques (e.g., email, SMS, MMS, instant messaging), and so on.

Consequently, the mobile device may be configured to support a variety of different communication techniques over different frequency ranges, such as a telephone network to engage in a wide area network wireless connection as well as local area network wireless connection, such as through one or more standards in compliance with IEEE 802.11.

Traditional techniques that were utilized to support this wireless communication, however, relied on separate antennas that were specifically tuned to support a particular technique. Thus, design of the mobile device may be constrained using traditional techniques that involved inclusion of a separate antenna for each of the wireless communication techniques supported by the device.

SUMMARY

Multi-use antenna techniques are described. In one or more implementations, a device includes a single fixed radiating structure, a first branch coupled to the single fixed radiating structure to tune to a first frequency range to support a first wireless signal technique, and a second branch coupled to the single fixed radiating structure to tune to a second frequency range to support a second wireless signal technique, the second frequency range being different than the first frequency range.

In one or more implementations, a first wireless signal is received via a fixed radiating structure at a first stage of an antenna of a device, the first stage configured to tune to a first range of frequencies. A second wireless signal is received via the fixed radiating structure at a second stage of the antenna of the device, the second stage configured to tune to a second range of frequencies that are different than the first range of frequencies.

In one or more implementations, an apparatus includes an antenna including a single fixed radiating structure and a plurality of branches, each of the branches being communicatively coupled to the single fixed radiating structure and configured to tune to a respective frequency range using resonators and filters. The apparatus also includes a plurality of radios, each of which being communicatively coupled to a respective said branch and configured to support a wireless signal technique.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE DRAWINGS

The detailed description is described with reference to the accompanying figures. In the figures, the left-most digit(s) of a reference number identifies the figure in which the reference number first appears. The use of the same reference numbers in different instances in the description and the figures may indicate similar or identical items. Entities represented in the figures may be indicative of one or more entities and thus reference may be made interchangeably to single or plural forms of the entities in the discussion.

DETAILED DESCRIPTION

Overview

Features are continually added to devices which may complicate configuration of the device, especially for mobile use. One such example is the continued expansion of wireless signal techniques that may be incorporated by the device, such as to communicate with another device. These techniques conventionally involved use of a separate antenna for each frequency range that was to be supported by the device, such as to support local and wide area wireless networks. Consequently, design of devices that were to support multiple wireless signal techniques may be constrained by the antennas used by these techniques.

Multi-use antennas are described. In one or more implementations, an antenna may be designed to support multiple different wireless signal techniques. These techniques may include power transfer such as to support charging of a device using induction as well as one or more wireless communication techniques, such as near field communication (NFC), short-range wireless connections (e.g., Bluetooth), local area wireless networks (e.g., one or more standards in compliance with IEEE 802.11), wide area wireless networks (e.g., one or more standard in compliance with IEEE 802.16, wireless telephone networks), and so on.

In one example, the antenna is configured to support dynamic tuning of a fixed radiating structure. For example, the antenna may include a fixed radiating structure (e.g., a coil) along with a series of branches that are configured to use resonators and filtering to support different frequency bands. Thus, the antenna may be configured without use of switches and/or multiple stubs that were conventionally used to change the radiating structure, which were complex and provided limited support of different bands. Further discussion of multi-use antennas may be found in relation to the following sections.

In the following discussion, an example environment is first described that may employ the techniques described herein. Example procedures are then described which may be performed in the example environment as well as other environments. Consequently, performance of the example procedures is not limited to the example environment and the example environment is not limited to performance of the example procedures.

Example Environment

Figure 1:
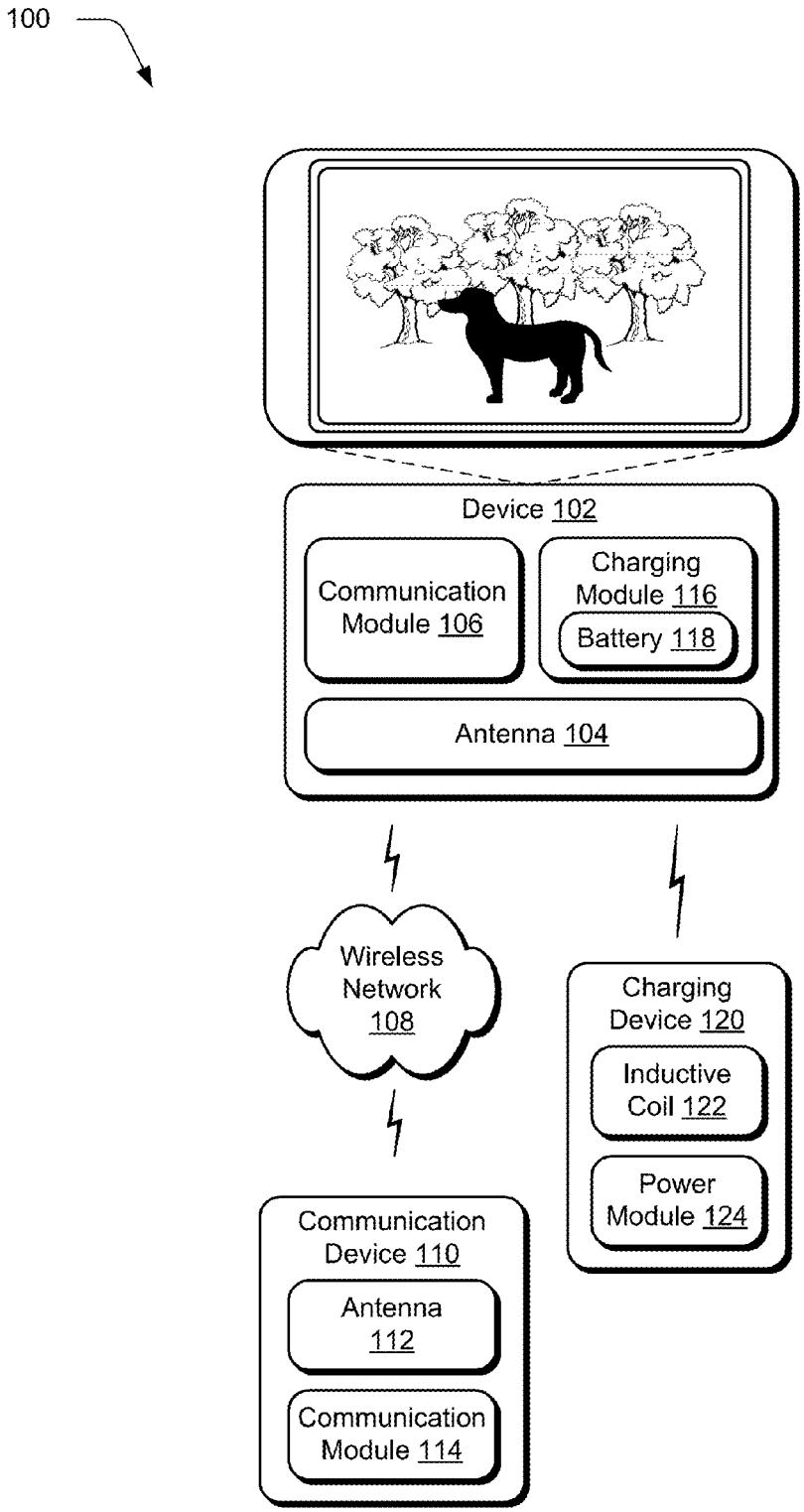
FIG. 1 is an illustration of an environment in an example implementation that is operable to employ multi-use antenna techniques described herein.

FIG. 1 is an illustration of an environment 100 in an example implementation that is operable to employ multi-use antenna techniques described herein. The illustrated environment 100 includes a device 102, which may be configured as an electrical device that includes an antenna 104 configured to support a plurality of different wireless signal techniques.

Although the device 102 is illustrated as a mobile device (e.g., a mobile communications device such as a wireless phone or tablet computer), the device 102 may assume a wide variety of configurations. For example, the device 102 may be configured as a computing device such as a computer that is capable of wireless communication, such as a desktop computer, a mobile station, an entertainment appliance, a set-top box communicatively coupled to a display device, a wireless phone, a game console, and so forth. The device 102 may also assume a variety of other electrical configurations, such as a portable device such as a game controller, remote control device, input/output device, peripheral device, and so on.

Thus, the device 102 may range from full resource devices with substantial resources (e.g., personal computers, game consoles) to a low-resource device with limited resources (e.g., remote controls for televisions, game controller, and so forth). Additionally, although a single device 102 is shown, the device 102 may be representative of a plurality of different devices, such as a remote control and set-top box combination, a game controller and game console, and so on.

The device is illustrated as including a communication module 106. The communication module 106 is representative of functionality of the device 102 to employ one or more wireless communication techniques, such as to communicate via a wireless network 108 with a communication device 110. The communication module 106, for instance, may be configured to support one or more wireless communication techniques. These wireless communication techniques may be configured in a variety of different ways, such as to support near field communication (NFC), short range wireless communication (e.g., Bluetooth), local area wireless networks (e.g., one or more standards in compliance with IEEE 802.11), wide area wireless networks (e.g., one or more standards in compliance with IEEE 802.16, wireless telephone networks including 3G, 4G, LTE, GSM, CDMA), and so forth.

For example, the communication module 106 may be configured to employ the antenna 104 to send and/or receive signals communicated via the wireless network 108 with one or more other devices, such as communication device 110. To support this communication, the communication device 110 is illustrated as also including an antenna 112 and communication module 114 that may be configured to be the same as, or different from the communication module 106 and antenna 104 of the device 102. In one or more implementations described herein, the communication module 106 may employ the antenna 104 for a plurality of different wireless communication techniques, e.g., techniques that involve different frequency ranges as described above. Thus, a single antenna 104 may be employed by the device 104, thereby expanding configuration options of the device 102 over conventional techniques that involved a separate antenna for each technique.

In one or more implementations, the antenna 104 may also be configured to support other wireless signal techniques, such as power transfer to the device 102 using induction. The device 102, for instance, is illustrated as including a charging module 116 which is representative of functionality of the device 102 to charge a battery 118 wirelessly using the antenna 104. The antenna 104, for instance, may be configured as an inductive coil configured to receive power wirelessly transmitted via induction by a charging device 102 using an inductive coil 122 and power module 124. In one or more implementations the antenna 104 may also support different frequency ranges to support inductive charging.

Thus, the device 102 may employ the antenna 104 as an indicative coil to charge the battery 118 as well as to support one or more wireless communications techniques. In this way, a single antenna 104 may support multiple wireless uses, further discussion of which may be found in relation to FIG. 2.

Generally, any of the functions described herein can be implemented using software, firmware, hardware (e.g., fixed logic circuitry), or a combination of these implementations. The terms "module," "functionality," and "logic" as used herein generally represent software, firmware, hardware, or a combination thereof. In the case of a software implementation, the module, functionality, or logic represents program code that performs specified tasks when executed on a processor (e.g., CPU or CPUs). The program code can be stored in one or more computer readable memory devices. The features of the techniques described below are platform-independent, meaning that the techniques may be implemented on a variety of commercial computing platforms having a variety of processors.

For example, the device 102 may also include an entity (e.g., software) that causes hardware of the device 102 to perform operations, e.g., processors, functional blocks, and so on. For example, the device 102 may include a computer-readable medium that may be configured to maintain instructions that cause the computing device, and more particularly hardware of the device 102 to perform operations. Thus, the instructions function to configure the hardware to perform the operations and in this way result in transformation of the hardware to perform functions. The instructions may be provided by the computer-readable medium to the device 102 through a variety of different configurations.

One such configuration of a computer-readable medium is signal bearing medium and thus is configured to transmit the instructions (e.g., as a carrier wave) to the hardware of the computing device, such as via a network. The computer-readable medium may also be configured as a computer-readable storage medium and thus is not a signal bearing medium. Examples of a computer-readable storage medium include a random-access memory (RAM), read-only memory (ROM), an optical disc, flash memory, hard disk memory, and other memory devices that may use magnetic, optical, and other techniques to store instructions and other data.

Figure 2:
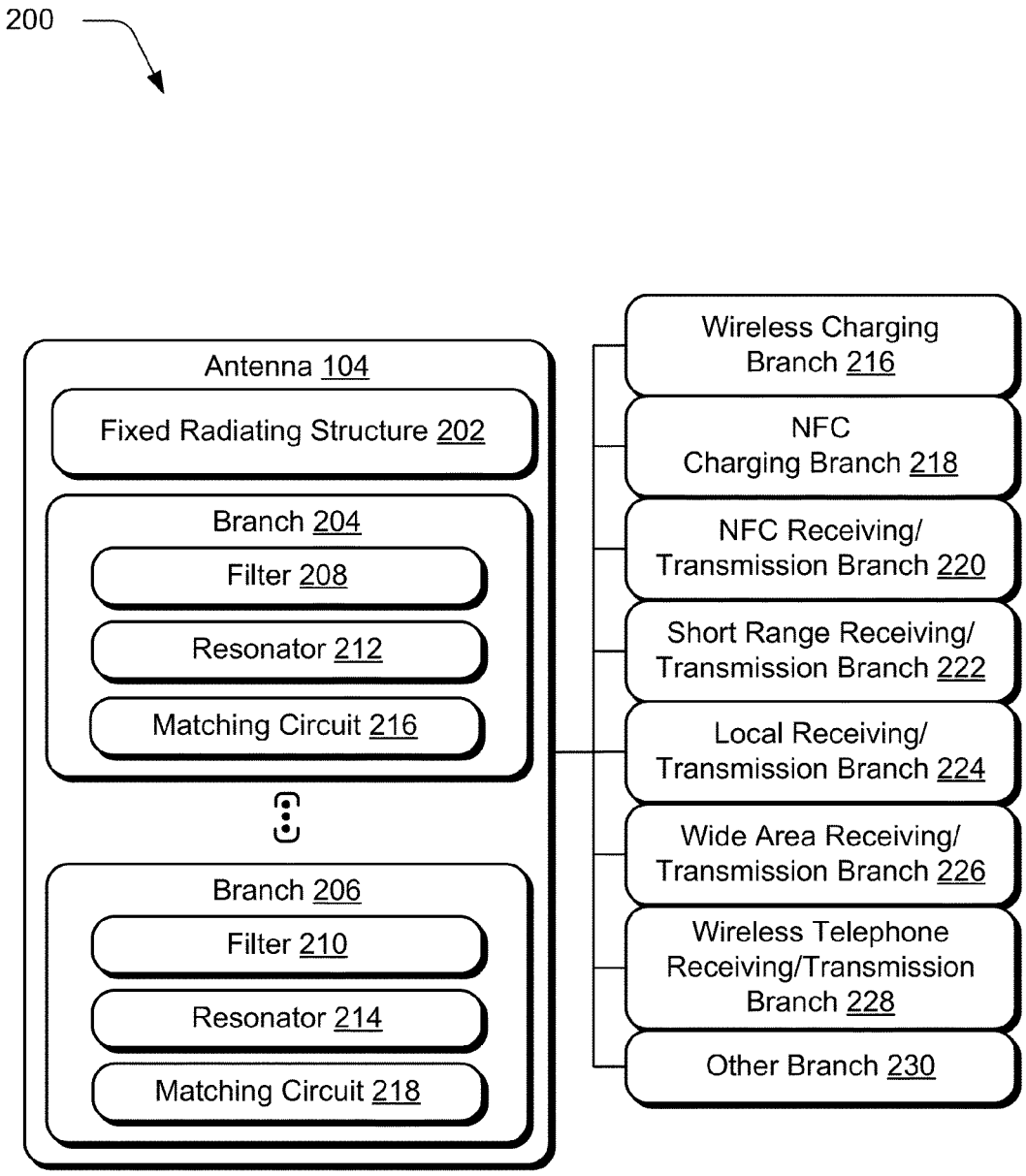
FIG. 2 is an illustration of a system in an example implementation showing an antenna of FIG. 1 in greater detail.

FIG. 2 is an illustration of a system 200 in an example implementation showing the antenna 104 of FIG. 1 in greater detail. The antenna 104 in this example is illustrated as including a fixed radiating structure 202. The fixed radiating structure 202 may be configured in a variety of ways, such as to function as an inductive coil, to transmit or receive a wireless signal, and so on. The fixed radiating structure 202 is fixed in that does not change its physical characteristics, e.g., such as through the use of switches or inclusion of multiple stubs as was conventionally performed.

In the illustrated example, the antenna 104 employs a plurality of branches 204, 206 that may be used to dynamically tune the fixed radiating structure 202. Each of the branches 204, 206, for instance, may be configured to include a filter 208, 210, resonator 212, 214, and matching circuit 216, 218 (e.g., to minimize signal reflection between the fixed radiating structure 202 and a respective radio) to tune to a particular frequency range to support a wireless signal technique. Thus, different branches may be added to the antenna 104 and put in contact with the single fixed radiating structure 202 to support different wireless signal techniques.

For example, different radios of the device 102 may be communicatively coupled to a respective one of the branches 204, 206. Illustrated examples of branches that may be used to support different wireless signal techniques include a wireless charging branch 216, an NFC charging branch 218, a NFC receiving/transmission branch 220, a short range receiving transmission branch 222 (e.g., to support Bluetooth), a local receiving/transmission branch 224 (e.g., to support IEEE 802.11), a wide area receiving/transmission branch 226 (e.g., to support IEEE 802.16), a wireless telephone receiving/transmission branch 228 (e.g., to support 3G, 4G, LTE and other evolutions of GSM and/or CDMA), and other branch 230 representative of other wireless signal techniques that may involve wireless transmission of signals. An example of a system showing examples of the branches 204, 206 of the antenna and the fixed radiating structure 202 may be found in relation to the following figure.

Figure 3:
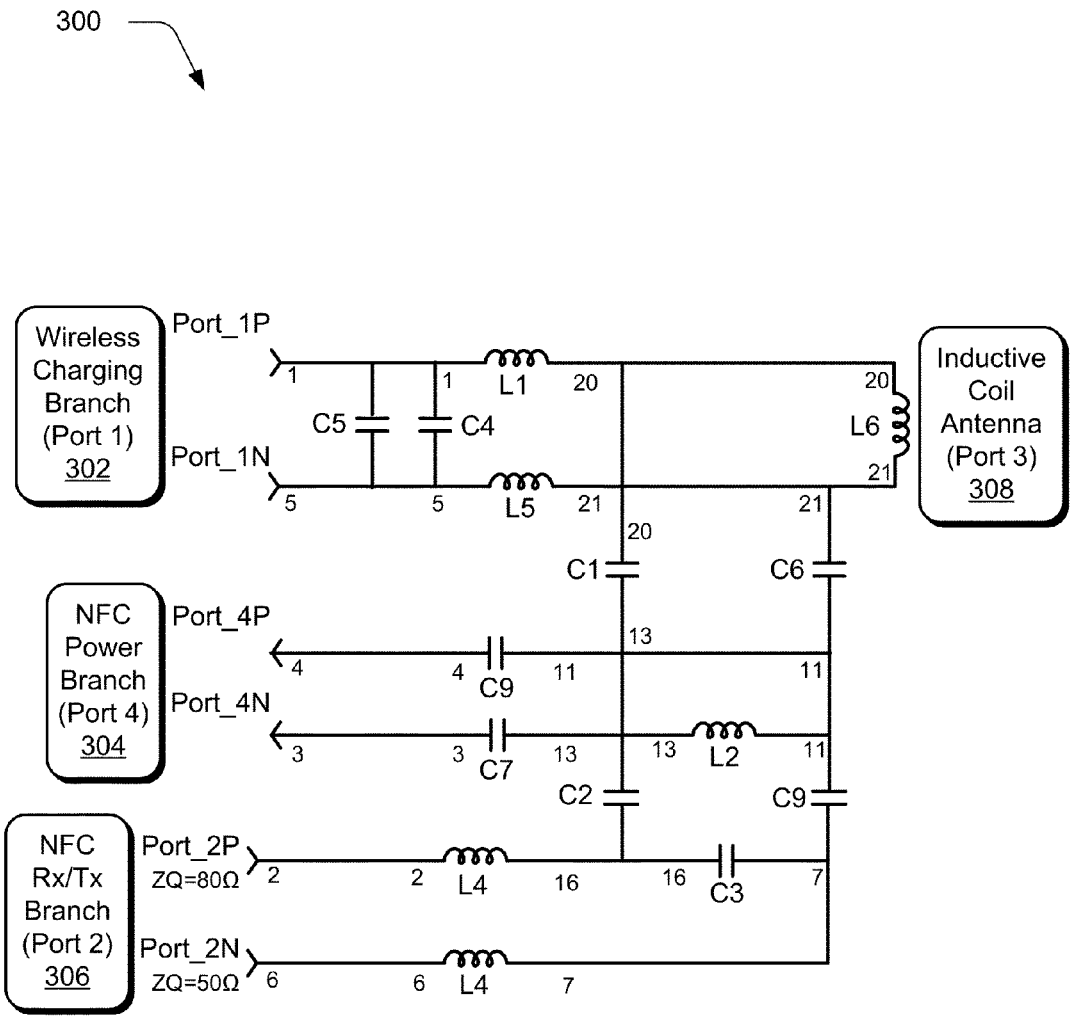
FIG. 3 depicts a system in an example implementation showing the antenna of FIG. 2 as including branches configured to dynamically tune a fixed radiating structure of the antenna.

FIG. 3 depicts a system 300 in an example implementation showing the antenna 104 as including branches configured to dynamically tune a fixed radiating structure of the antenna 104. In this example system 300, the device 102 is configured to support both wireless charging and RFID/NFC. Additionally, the system 300 includes a wireless charging branch 302, an NFC power branch 304, and NFC Rx/Tx branch 306 that are connected to a single inductive coil antenna (L6) 308. Thus, the fixed radiating structure 202 of FIG. 2 is implemented as a single inductive coil antenna 308 at L6. In one or more implementations, the system 300 may be configured to support a frequency range between 110 to 205 kHz for wireless charging and another frequency range at 13.56 MHz for RFID/NFC. Thus, an antenna may be formed using a single inductive to function also as a radiator or coupler to support a variety of different wireless signal techniques.

For the wireless charging branch 302, L1 and L5 acts as a filter to allow a wireless charging signal (e.g., from 110 to 205 kHz) to pass through. L1 and L5 may also function to become open circuit to prevent NFC signals (e.g., approximately 13.56 MHz in this example) from leaking through. C4 and C5 are configured to act as a parallel resonator with L1, L5, and L6 to maximize the wireless charging signal. In addition, L1, L5, C4, and C5 serve as a matching network for the wireless charging radio of the wireless charging branch 302.

For NFC power branch 304, C1 and C6 acts as a filter to allow the NFC charging signal to pass through. Further, C1 and C6 are configured to become an open circuit to prevent the wireless charging signal that is to be communicated to the wireless charging branch 302 from leaking through. L2 acts parallel resonator with C1, C6, and L6 to maximize the NFC charging signal. C7 and C9 then couple the NFC carrier to the NFC power branch 304 for energy harvesting.

For the NFC Rx/Tx branch 306, C1, C6, and L2 act similar to the NFC power branch to allow a Rx/Tx signal to pass through and are configured to become an open circuit that is also configured to prevent the wireless charging signal from leaking through. C2 and C9 provide matching to the NFC Rx/Tx radio of the NFC Rx/Tx Branch 306. L3, L4, and C3 serve as a low pass filter to remove harmonics come from the NFC Tx.

Thus, the system 300 provides for utilization of filter, resonator, and matching networks for each radio branch to broaden the frequency response of the inductive coil antenna 308. In effect, this increases the frequency coverage of the single inductor coil antenna that would otherwise be used in a narrower band. Thus, the filter, resonator, and matching network for each radio branch provide individual branches 204, 206 described previously in relation to FIG. 2. Each branch is configured to couple from the inductive coil antenna 308 to the each inductive coupling wireless technology or radio branch, and thus although wireless charging and NFC were described it should be readily apparent that a wide variety of wireless signal techniques may be addressed by these branches.

The system 300, therefore, provides for multiple network branches to be coupled to a single inductive coil radiator, coupler, or antenna. Each network branch may appear as an open circuit to the other network branches to minimize signal leakage to the other network branches. Further, each network branch may be impedance matched to a respective radio of that branch to maximize the signal transfer from the inductive coil antenna to the respective radio. Further discussion of these and other techniques may be found in relation to the following procedure.

Example Procedure

The following discussion describes multi-use antenna techniques that may be implemented utilizing the previously described systems and devices. Aspects of each of the procedures may be implemented in hardware, firmware, or software, or a combination thereof. The procedures are shown as a set of blocks that specify operations performed by one or more devices and are not necessarily limited to the orders shown for performing the operations by the respective blocks. In portions of the following discussion, reference will be made to the environment 100 of FIG. 1 and the systems 200, 300 of FIGS. 2 and 3, respectively.

Figure 4:
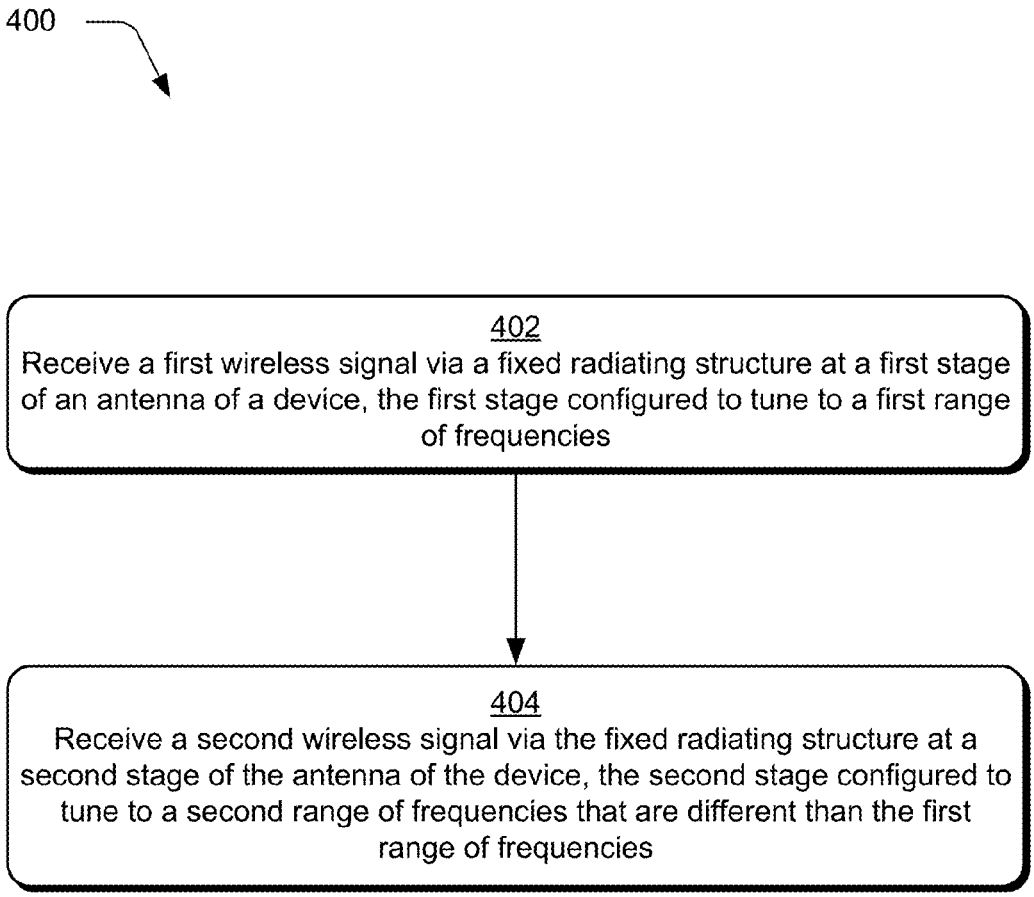
FIG. 4 is a flow diagram depicting a procedure in an example implementation in which a single fixed radiating structure is used by multiple stages to tune to different frequency ranges to support wireless signal techniques.

FIG. 4 depicts a procedure 400 in an example implementation in which a single fixed radiating structure is used by multiple stages to tune to different frequency ranges to support wireless signal techniques. A first wireless signal is received via a fixed radiating structure at a first stage of an antenna of a device, the first stage configured to tune to a first range of frequencies (block 402). For example, an inductive coil may be used to receive a signal usable to wirelessly charge a battery 118 of the device 102, provide power for communication (e.g., an NFC power branch 304), may receive a signal usable to perform wireless communication, and so on.

A second wireless signal is received via the fixed radiating structure at a second stage of the antenna of the device, the second stage configured to tune to a second range of frequencies that are different than the first range of frequencies (block 404). Continuing with the previous example, the inductive coil may also be used to receive a signal usable to wirelessly charge a battery 118 of the device 102, provide power for communication (e.g., an NFC power branch 304), may receive a signal usable to perform wireless communication, and so on. In this instance, however, the signal is received in a different range of frequencies (e.g., non-overlapping, separate by an order of magnitude, and so on) than the range of frequencies used to support the first signal. Thus, a variety of different wireless signal techniques may leverage the multi-use antenna techniques described herein.

Example System and Device

Figure 5:
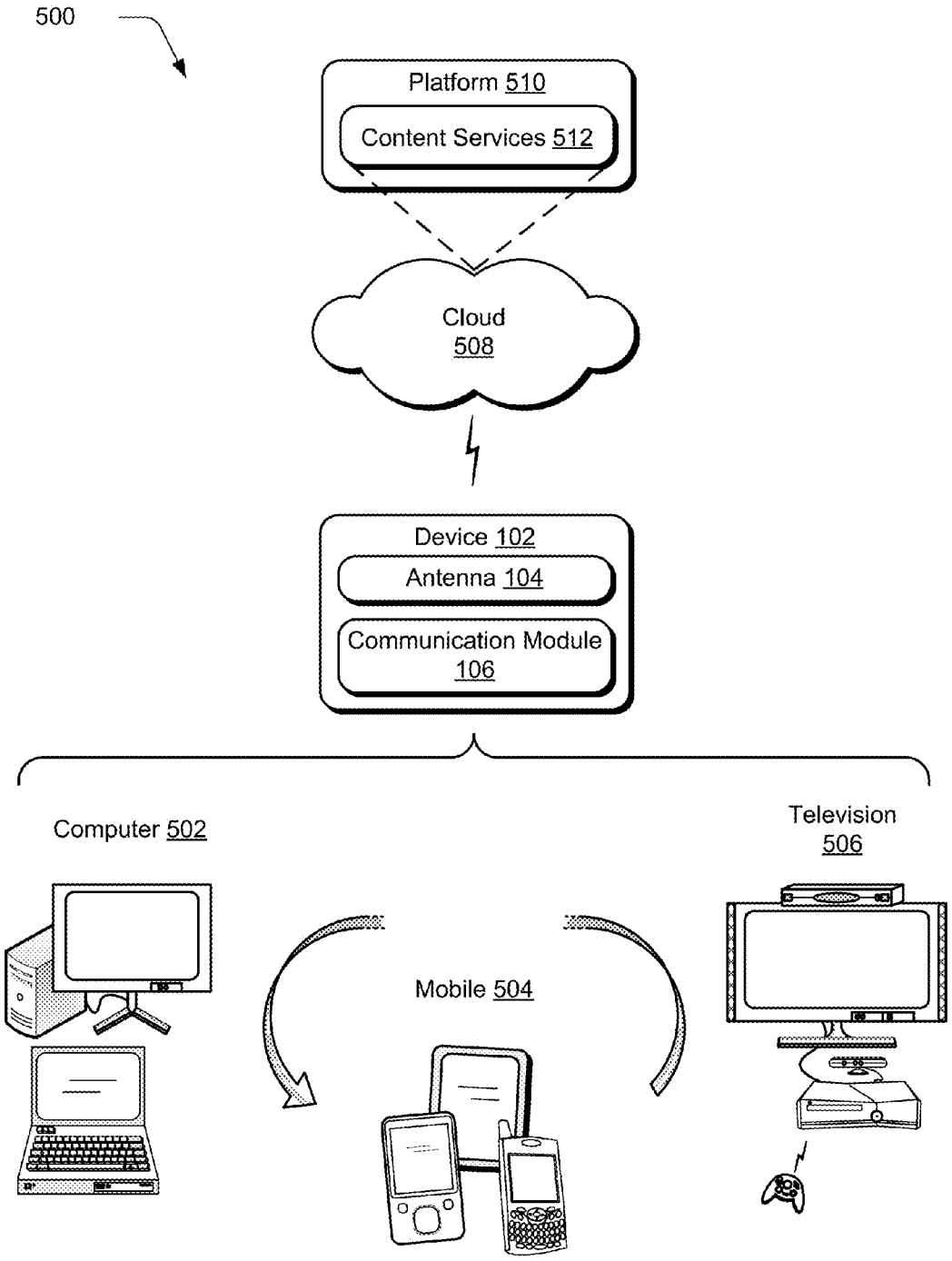
FIG. 5 illustrates an example system that includes the device as described with reference to FIG. 1.

FIG. 5 illustrates an example system 500 that includes the device 102 as described with reference to FIG. 1 as well as the antenna 104 and communication module 106. The example system 500 enables ubiquitous environments for a seamless user experience when running applications on a personal computer (PC), a television device, and/or a mobile device. Services and applications run substantially similar in all three environments for a common user experience when transitioning from one device to the next while utilizing an application, playing a video game, watching a video, and so on.

In the example system 500, multiple devices are interconnected through a central computing device. The central computing device may be local to the multiple devices or may be located remotely from the multiple devices. In one embodiment, the central computing device may be a cloud of one or more server computers that are connected to the multiple devices through a network, the Internet, or other data communication link. In one embodiment, this interconnection architecture enables functionality to be delivered across multiple devices to provide a common and seamless experience to a user of the multiple devices. Each of the multiple devices may have different physical requirements and capabilities, and the central computing device uses a platform to enable the delivery of an experience to the device that is both tailored to the device and yet common to all devices. In one embodiment, a class of target devices is created and experiences are tailored to the generic class of devices. A class of devices may be defined by physical features, types of usage, or other common characteristics of the devices.

In various implementations, the computing device 102 may assume a variety of different configurations, such as for computer 502, mobile 504, and television 506 uses. Each of these configurations includes devices that may have generally different constructs and capabilities, and thus the computing device 102 may be configured according to one or more of the different device classes. For instance, the computing device 102 may be implemented as the computer 502 class of a device that includes a personal computer, desktop computer, a multi-screen computer, laptop computer, netbook, and so on.

The computing device 102 may also be implemented as the mobile 504 class of device that includes mobile devices, such as a mobile phone, portable music player, portable gaming device, a tablet computer, a multi-screen computer, and so on. The computing device 102 may also be implemented as the television 506 class of device that includes devices having or connected to generally larger screens in casual viewing environments. These devices include televisions, set-top boxes, gaming consoles, and so on. The techniques described herein may be supported by these various configurations of the computing device 102 and are not limited to the specific examples the techniques described herein.

The cloud 508 includes and/or is representative of a platform 510 for content services 512. The platform 510 abstracts underlying functionality of hardware (e.g., servers) and software resources of the cloud 508. The content services 512 may include applications and/or data that can be utilized while computer processing is executed on servers that are remote from the computing device 102. Content services 512 can be provided as a service over the Internet and/or through a subscriber network, such as a cellular or Wi-Fi network.

The platform 510 may abstract resources and functions to connect the computing device 102 with other computing devices. The platform 510 may also serve to abstract scaling of resources to provide a corresponding level of scale to encountered demand for the content services 512 that are implemented via the platform 510. Accordingly, in an interconnected device embodiment, implementation of functionality of the functionality described herein may be distributed throughout the system 500. For example, the functionality may be implemented in part on the computing device 102 as well as via the platform 510 that abstracts the functionality of the cloud 508.

Figure 6:
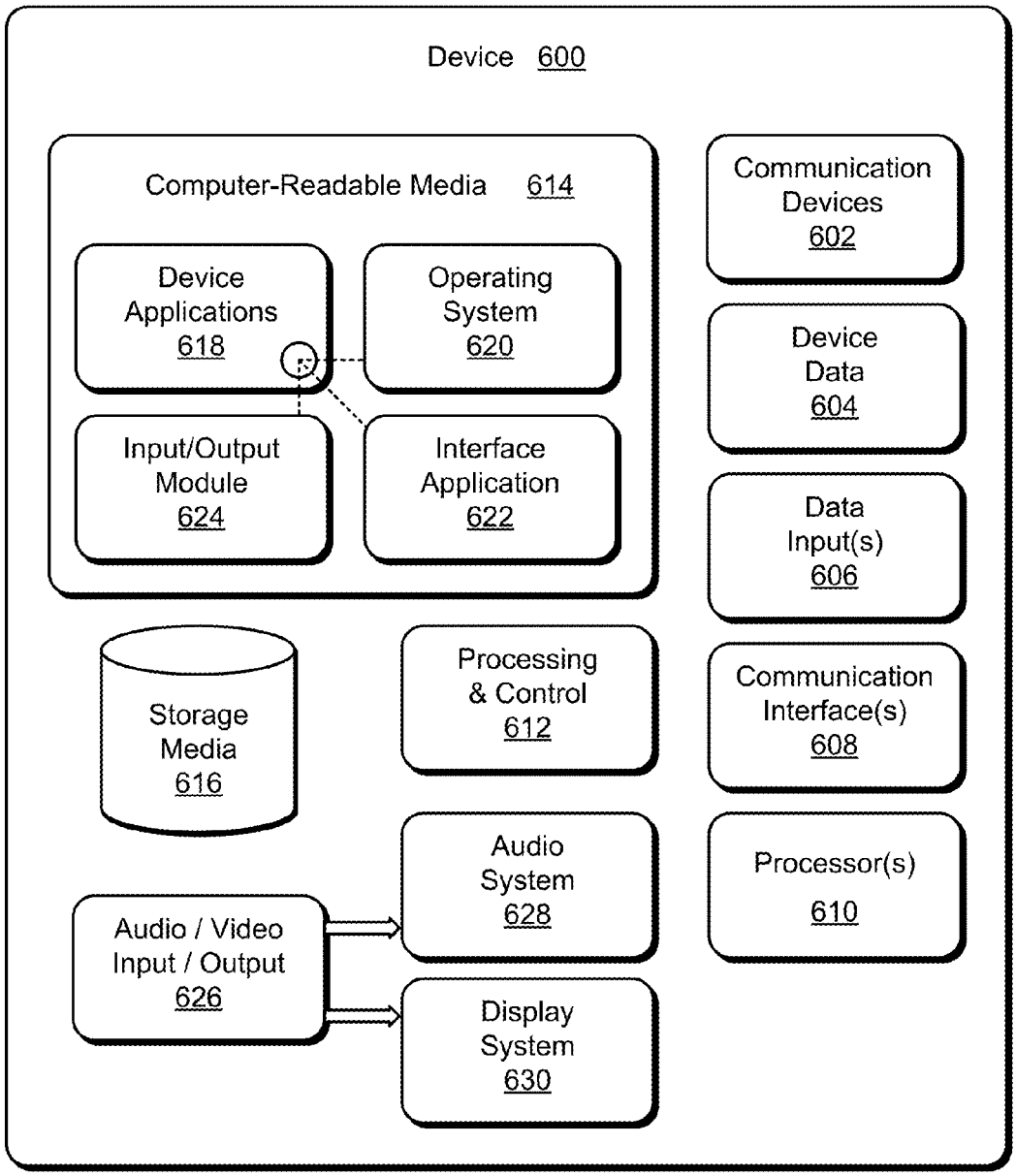
FIG. 6 illustrates various components of an example device that can be implemented as any type of device as described with reference to FIGS. 1-3 and 5 to implement embodiments of the techniques described herein.

FIG. 6 illustrates various components of an example device 600 that can be implemented as any type of computing device as described with reference to FIGS. 1, 2, and 5 to implement embodiments of the techniques described herein. Device 600 includes communication devices 602 that enable wired and/or wireless communication of device data 604 (e.g., received data, data that is being received, data scheduled for broadcast, data packets of the data, etc.). The device data 604 or other device content can include configuration settings of the device, media content stored on the device, and/or information associated with a user of the device. Media content stored on device 600 can include any type of audio, video, and/or image data. Device 600 includes one or more data inputs 606 via which any type of data, media content, and/or inputs can be received, such as user-selectable inputs, messages, music, television media content, recorded video content, and any other type of audio, video, and/or image data received from any content and/or data source.

Device 600 also includes communication interfaces 608 that can be implemented as any one or more of a serial and/or parallel interface, a wireless interface (and thus may include the antenna 104 of FIGS. 1-3), any type of network interface, a modem, and as any other type of communication interface. The communication interfaces 608 provide a connection and/or communication links between device 600 and a communication network by which other electronic, computing, and communication devices communicate data with device 600.

Device 600 includes one or more processors 610 (e.g., any of microprocessors, controllers, and the like) which process various computer-executable instructions to control the operation of device 600 and to implement embodiments of the techniques described herein. Alternatively or in addition, device 600 can be implemented with any one or combination of hardware, firmware, or fixed logic circuitry that is implemented in connection with processing and control circuits which are generally identified at 612. Although not shown, device 600 can include a system bus or data transfer system that couples the various components within the device. A system bus can include any one or combination of different bus structures, such as a memory bus or memory controller, a peripheral bus, a universal serial bus, and/or a processor or local bus that utilizes any of a variety of bus architectures.

Device 600 also includes computer-readable media 614, such as one or more memory components, examples of which include random access memory (RAM), non-volatile memory (e.g., any one or more of a read-only memory (ROM), flash memory, EPROM, EEPROM, etc.), and a disk storage device. A disk storage device may be implemented as any type of magnetic or optical storage device, such as a hard disk drive, a recordable and/or rewriteable compact disc (CD), any type of a digital versatile disc (DVD), and the like. Device 600 can also include a mass storage media device 616.

Computer-readable media 614 provides data storage mechanisms to store the device data 604, as well as various device applications 618 and any other types of information and/or data related to operational aspects of device 600. For example, an operating system 620 can be maintained as a computer application with the computer-readable media 614 and executed on processors 610. The device applications 618 can include a device manager (e.g., a control application, software application, signal processing and control module, code that is native to a particular device, a hardware abstraction layer for a particular device, etc.). The device applications 618 also include any system components or modules to implement embodiments of the techniques described herein. In this example, the device applications 618 include an interface application 622 and an input/output module 624 that are shown as software modules and/or computer applications. The input/output module 624 is representative of software that is used to provide an interface with a device configured to capture inputs, such as a touchscreen, track pad, camera, microphone, and so on. Alternatively or in addition, the interface application 622 and the input/output module 624 can be implemented as hardware, software, firmware, or any combination thereof. Additionally, the input/output module 624 may be configured to support multiple input devices, such as separate devices to capture visual and audio inputs, respectively.

Device 600 also includes an audio and/or video input-output system 626 that provides audio data to an audio system 628 and/or provides video data to a display system 630. The audio system 628 and/or the display system 630 can include any devices that process, display, and/or otherwise render audio, video, and image data. Video signals and audio signals can be communicated from device 600 to an audio device and/or to a display device via an RF (radio frequency) link, S-video link, composite video link, component video link, DVI (digital video interface), analog audio connection, or other similar communication link. In an embodiment, the audio system 628 and/or the display system 630 are implemented as external components to device 600. Alternatively, the audio system 628 and/or the display system 630 are implemented as integrated components of example device 600.

CONCLUSION

Although the invention has been described in language specific to structural features and/or methodological acts, it is to be understood that the invention defined in the appended claims is not necessarily limited to the specific features or acts described. Rather, the specific features and acts are disclosed as example forms of implementing the claimed invention.

What is claimed is:

1. A device comprising:

a battery;

a single fixed radiating structure comprising a single inductive coil;

a wireless charging branch coupled to the single fixed radiating structure to tune to a first frequency range, via inductive coupling of the single fixed radiating structure, to support wireless charging of the battery of the device; and a near field communication (NFC) power branch coupled to the single fixed radiating structure to tune to a second frequency range, via inductive coupling of the single fixed radiating structure, to support a wireless near field communication (NFC) technique, the second frequency range being different than the first frequency range;

wherein the wireless charging branch includes a pair of inductors that without the use of a switch allows a wireless charging signal to pass through and prevents a signal corresponding to the wireless near field communication (NFC) technique from leaking through, the wireless charging signal usable to wirelessly charge the battery of the device; and wherein the near field communication (NFC) power branch includes a pair of capacitors that without the use of a switch allows an NFC charging signal to pass through and prevent the wireless charging signal that supports wireless charging of the battery of the device from leaking through.

2. A device as described in claim 1, wherein the first and second branches are configured to use the single fixed radiating structure serially or in parallel.

3. A device as described in claim 1, wherein the first frequency range and the second frequency range reference non-overlapping ranges of frequencies.

4. A device as described in claim 1, wherein the first frequency range and the second frequency range are different by at least an order of magnitude.

5. A device as described in claim 1, wherein the first and second branches are configured to perform respective said tuning using resonators and filters.

6. A device as described in claim 1, wherein the first and second branches are communicatively coupled to respective radios.

7. The device of claim 1, wherein near field communication (NFC) power branch also includes one or more inductors that, together with the pair of capacitors, act as a parallel resonator to maximize the NFC charging signal.

8. A method comprising:

receiving a first wireless signal via inductive coupling of a fixed radiating structure at a first stage of an antenna of a device, the first stage configured to tune to a first range of frequencies, the fixed radiating structure comprising a single inductive coil; and receiving a second wireless signal via inductive coupling of the fixed radiating structure at a second stage of the antenna of the device, the second stage configured to tune to a second range of frequencies that are different than the first range of frequencies;

wherein the first wireless signal is for use in charging a battery of the device; and wherein the second wireless signal is for use in providing power for near field communication (NFC);

wherein the first stage includes a pair of inductors that without the use of a switch allows the first signal, but not the second signal, to pass; and wherein the second stage includes a pair of capacitors that without the use of a switch allows the second signal, but not the first signal, to pass.

9. A method as described in claim 8, wherein the device is a mobile phone or tablet.

10. A method as described in claim 8, wherein the first stage of the device is connected to a radio that supports wireless charging.

11. An apparatus comprising:

an antenna including a single fixed radiating structure comprising a single inductive coil and a plurality of branches, each said branch:

communicatively coupled to the single fixed radiating structure; and configured to tune to a respective frequency range using resonators and filters; and a plurality of radios, each of which is communicatively coupled to a respective said branch and configured to support a wireless signal technique via inductive coupling of the single fixed radiating structures;

wherein each said branch is configured to pass a respective signal for use by the branch and to prevent one or more signal(s) for use by the one or more other branch(es) from leaking through, without the use of a switch;

wherein the signal passed by one of the branches is for use in charging a battery; and wherein the signal passed by another one of the branches is for use in providing power for near field communication (NFC).

12. An apparatus as described in claim 11, wherein a first said radio is configured to support wireless charging of a battery of the apparatus.

13. An apparatus as described in claim 12, wherein a second said radio is configured to support wireless communication.

* * * * *